US005242786A

United States Patent [19]

Tanaka et al.

[11] Patent Number: 5,242,786

[45] Date of Patent: Sep. 7, 1993

[54] SILVER HALIDE PHOTOGRAPHIC LIGHT-SENSITIVE MATERIAL

[75] Inventors: Shigeo Tanaka; Tsuyoshi Ikeda, both of Hino, Japan

[73] Assignee: Konica Corporation, Tokyo, Japan

[21] Appl. No.: 836,128

[22] Filed: Feb. 14, 1992

[30] Foreign Application Priority Data

Feb. 19, 1991 [JP] Japan ..... 2-46155

[51] Int. Cl.[5] ..... G03C 1/76

[52] U.S. Cl. ..... 430/523; 430/496; 430/950; 430/538; 430/935

[58] Field of Search ..... 430/523, 496, 950, 538, 430/935

[56] References Cited

U.S. PATENT DOCUMENTS

| | | | |
|---|---|---|---|
| 3,853,585 | 12/1974 | Tatsuta et al. | 430/496 |
| 3,892,573 | 7/1975 | Tatsuta et al. | 430/935 |
| 4,145,480 | 3/1979 | Kusama et al. | 430/523 |
| 4,179,541 | 12/1979 | Miyama et al. | 430/496 |
| 4,707,435 | 11/1987 | Lyons et al. | 430/494 |
| 4,851,327 | 7/1989 | Fuchizawa et al. | 430/502 |
| 4,883,738 | 11/1989 | Yamada | 430/203 |
| 4,921,781 | 5/1990 | Takamuki et al. | 430/496 |
| 5,075,204 | 12/1991 | Shiba et al. | 430/496 |

FOREIGN PATENT DOCUMENTS

| | | |
|---|---|---|
| 57-53941 | 11/1982 | Japan . |
| 2-280142 | 11/1990 | Japan . |

OTHER PUBLICATIONS

James, T. H., The Theory of the Photographic Process, Chapter 21, pp. 592–597, Macmillan Publishing Co., Inc., 1977.

Journal of the Optical Society of America, vol. 45, No. 10, pp. 799–808, Oct., 1955.

Research Disclosure, vol. 308, Item 308119, XIV-X-VII, Dec. 1989, Anonomous.

*Primary Examiner*—Charles L. Bowers, Jr.

*Assistant Examiner*—Thomas R. Neville

*Attorney, Agent, or Firm*—Frishauf, Holtz, Goodman & Woodward

[57] ABSTRACT

Disclosed is A silver halide photographic light-sensitive material formed by coating at least one silver halide photographic emulsion layer on a reflective support having irregularities at random on the surface, wherein the intensity of Wiener spectrum of the reflective support at a spatial frequency of f cycles/mm given by the expression $f=1120/CS$ is less than 90% of the geometric mean of the intensity at a spatial frequency of f/2 cycles/mm and the intensity at a spatial frequency of 2f cycles/mm when the coating speed for said silver halide emulsion layer is CS (m/minute). The silver halide photographic light-sensitive material according to the invention, has a proper gross and a high capability of depicting details of an image.

8 Claims, No Drawings

SILVER HALIDE PHOTOGRAPHIC LIGHT-SENSITIVE MATERIAL

FIELD OF THE INVENTION

The present invention relates to a silver halide photographic light sensitive material which has a proper gloss and a high capability of depicting details.

BACKGROUND OF THE INVENTION

Silver halide photographic light-sensitive materials are now used in large quantities and have gotten into many aspects of daily life in various forms, because of their high sensitivity, excellent gradation, sharpness and graininess, as well as their adaptability for mass-processing. For example, post cards printed from private photographs have come to be used as New Year's cards.

In photoprinting, there have been mainly used baryta paper and polyethylene-coated paper. Particularly, polyethylene-coated paper has been used in a large quantity, because it prevents processing chemicals from permeating into the support and thereby allows rapid processing and rapid drying. Various patterns can be formed on the surface of such polyethylene-coated paper by contacting a cooling roller engraved with various patterns with paper coated with molten polyethylene, in the course of cooling and solidification of the molten polyethylene. One typical example of such embossed surfaces is "silk surface" in which patterns of specific forms are regularly arranged (the kind of such embossing is hereinafter referred to as surface texture). In these patterned surface qualities, gloss is properly lowered as compared with an unembossed so-called glossy surface. Such an embossed surface has advantages of reflecting no light-source when viewed and leaving no finger marks when touched. On the other hand, it has disadvantages of giving an unnatural feeling when touched and causing an excessively hard gradation and a difficulty in looking details when viewed, on account of its distinctive irregularities. Accordingly, correction of such defects has been demanded.

Japanese Pat. Exam. Pub. No. 53941/1982 describes that a desirable surface gloss can be obtained with a photographic polyolefine-coated paper having an embossed surface containing 20 to 35 irregularities having a vertical difference of 5 to 20 μm and arranged at intervals of 3 mm. It further discloses that a vertical difference less than 5 μm makes it difficult to provide a desirable gloss, that a vertical difference more than 20 μm is not favorable because it blurs images, that when the number of irregularities with a vertical difference of 5 to 20 μm is less than 20, the gloss becomes too high, and that when the number is more than 35, the gloss is lowered so excessively as to give too much matting, causing undesirable results.

Japanese Pat. O.P.I. Pub. No. 280142/1990 describes that the unevenness in color and density can be minimized when a color photographic light-sensitive material having cyclic irreguralities in number of 4 to 20 per millimeter on the surface of support is processed under conditions to give a uniform color development.

THE OBJECT OF THE INVENTION

The object of the present invention is to provide a silver halide photographic light-sensitive material having a proper gloss, as well as a high capability of depicting details of an image.

Through a study to improve the image quality of silver halide photographic light-sensitive material having a support comprised of an embossed polyolefine-coated paper, the present inventors have found that the appearance of an image can be improved by selecting an appropriate relation between the distribution of irregularities on a support and the coating speed of a silver halide photographic emulsion.

DETAILED DESCRIPTION OF THE INVENTION

The present invention relates to a silver halide photographic light-sensitive material formed by coating at least one silver halide photographic emulsion layer on a reflective support having irregularities at random on the surface, wherein the intensity of Wiener spectrum (hereinafter referred to as WS) of said reflective support at a spatial frequency of f cycles/mm given by the expression $f=1120/CS$ is less than 90% of the geometric mean of the intensity at a spatial frequency of f/2 cycles/mm and the intensity at a spatial frequency of 2f cycles/mm when the coating speed for said silver halide emulsion layer is CS (m/minute).

Materials of reflective supports used in the invention may be any of conventional ones such as paper coated with polyethylene containing a white pigment, baryta paper, polyvinyl chloride sheets and supports made of white-pigment-containing polypropylene or polyethylene terephthalate. Of them, the most suitable support is one having a polyolefine surface to be embossed.

The depth of irregularities of the reflective support according to the invention is determined so as to meet the foregoing requirement for the intensity of WS, but it is preferably 0.1 to 20 μm, and especially 0.3 to 5 μm, when expressed as a vertical difference between bottom and top of irregularities.

The shape of irregularities of the reflective support according to the invention is not particularly limited, but preferably circular, elliptical, triangular, cubic, rectangular, parallelogrammatic, rhombic, pentagonal or hexagonal one. Combination of these shapes, such as one having a circular cavity in itself, is also useful.

The WS can be determined by subjecting a reflective support to be tested to densitometry using a microphotometer, for example, Konica Microdensitometer Model PDM-5, and calculating the results obtained according to the method described in the eighth chapter of Image Science by J. C. Dainty and R. Shaw, Academic Press, New York (1974).

In determining the WS according to the invention, a 10 μm×400 μm aperture is used in general. But when irregularities formed on the support surface are far smaller than that, an aperture smaller than the above is preferably used.

The reflective support used in the invention is characterized in that it has irregularities at random and that the intensity of WS at a spatial frequency of f cycles/mm is less than 90% of the geometric mean of the intensity at a spatial frequency of f/2 cycles/mm and the intensity at a spatial frequency of 2f cycles/mm. The value of WS at a spatial frequency of f cycles/mm is preferably less than 80%, especially less than 60% of the above geometric mean.

When the ratio of WS intensities at a spatial frequency of 2f cycles/mm to that at a spatial frequency of f/2 cycles/mm is within the range of $$0.15 \leqq \frac{WS_{2f}}{WS_{f/2}} \leqq 0.65,$$

the unnatural feeling owing to irregularities is further lessened and better results can be obtained.

In the invention, whether irregularities are present at random or not can be judged from results of WS measurement. When these irregularities have a regular pattern, a clear peak can be observed in the relation between WS and special frequency. When the ratio of such a peak to the intensity of WS before and behind the peak is taken, irregularities having no peak to give a ratio larger than 2:1 are regarded to be random in the invention. It is desirable that this intensity ratio be as small as possible, and irregularities having no peak at least in the special frequency area of 2 to 20 cycles/mm are particularly preferred.

Patterns having such frequency distributions can be formed in any of conventional manners. For example, these can be obtained, as stated above, by forming a pattern having a desired frequency distribution on a roller used in the course of cooling and solidification of molten polyolefine laminated on a paper support.

Though there is no adequate explication yet on the reason why a proper gloss and an image description are both satisfied when the above relation is valid between the coating speed of silver halide photographic emulsion and the cycle of irregularities on the support's surface, it is thought that when a support is conveyed, noise corresponding to the frequency of irregularities is generated at a contact point of coating solution and support and thereby description of details is impaired.

The silver halide photographic light-sensitive material according to the invention may be any of black-and-white photographic light-sensitive materials which use metal silver to form images, black-and-white photographic light-sensitive materials which use black dye images formed of black dyes or by balancing yellow, magenta and cyan dyes, and color photographic light-sensitive materials which use yellow, magenta and cyan dyes. Of them, the application to color photographic light-sensitive materials is particularly preferred.

Couplers used in the silver halide color photographic light-sensitive material according to the invention may be any of conventional couplers, but use of a properly selected magenta coupler further enhances the effect of the invention. Magenta couplers useful for the silver halide color photographic light-sensitive material of the invention are those whose color difference between a magenta colored portion and a minimum density portion is not less than 80.

The color difference between a colored portion and a minimum density portion mentioned here can be determined by steps of forming photographic structural layers including silver halide emulsion layers containing magenta couplers on a reflective support having a smooth surface, exposing it using light having a proper spectral composition, developing it to obtain magenta color patches of various colored densities and a white portion, and measuring their spectral absorption. Measurement of spectral absorption can be made under conditions C of the geometric conditions for lighting and light-intercepting prescribed in JIS Z-8722 (1982), and the color difference can be obtained by steps of determining tristimulus values X, Y and Z according to the method described in JIS Z-872 (1982), determining values of L*, a* and b* respectively according to the method described in JIS Z-8729 (1980), and determining a color difference according to the method described in JIS Z-8730 (1980).

As yellow couplers and magenta couplers suitable for the silver halide color photographic light-sensitive material of the invention, conventional couplers may be used in combination. Preferable yellow couplers are those compounds which are represented by the following formula [Y-I].

Formula [Y-I]

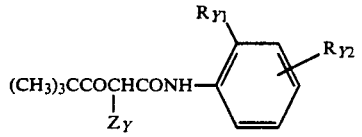

In the formula, $R_{Y1}$ represents a halogen atom or an alkoxy group, $R_{Y2}$ represents $-NHCOR_{Y3}SO_2R_{Y4'}$, $-COOR_{Y4'}$, $-NHCOR_{Y4'}$, $-COOR_{Y3}COOR_{Y4'}$, $-NSO_2R_{Y4}$ (with $R_{Y5}$) or $-SO_2NR_{Y4}$ (with $R_{Y5}$).

$R_{Y3}$ represents an alkylene group, $R_{Y4}$ represents an antidiffusible group, $R_{Y5}$ represents a hydrogen atom or an alkyl or aralkyl group, and $Z_Y$ represents a group capable of splitting off upon coupling.

Typical examples of preferable yellow couplers are exemplified below but not limited to them.

YC-1

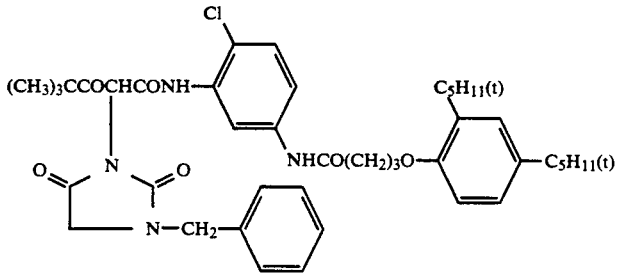

-continued
YC-2
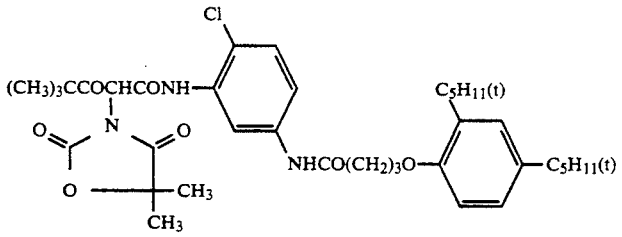
YC-3
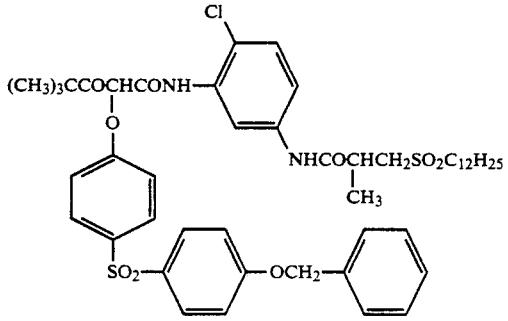
YC-4
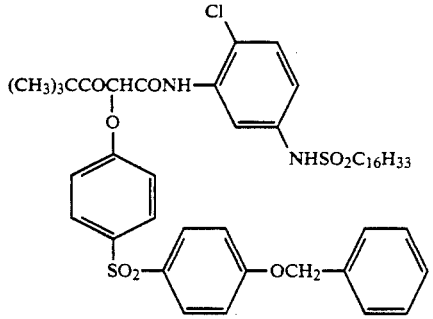
YC-5
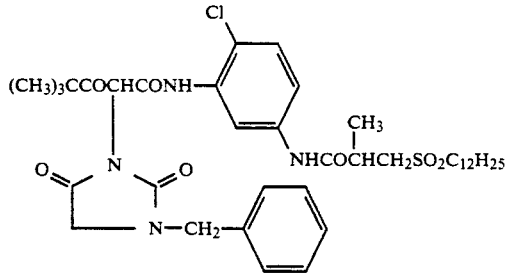
YC-6
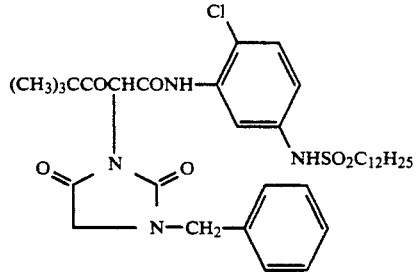
YC-7
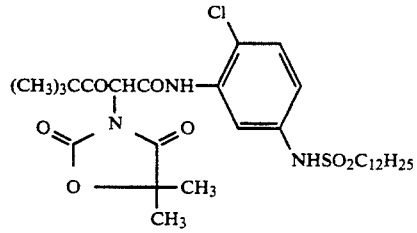

-continued

YC-8

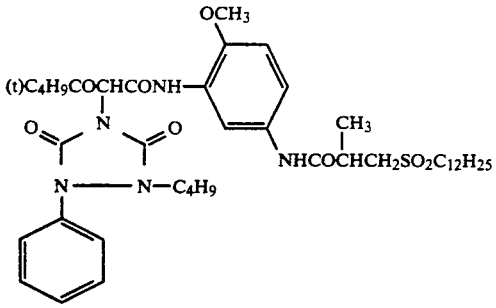

YC-9

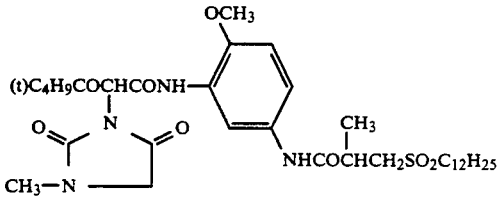

Magenta couplers preferably employed in the silver halide color photographic light-sensitive material of the invention are those represented by the following formula [M-I] or [M-II].

Formula [M-I]

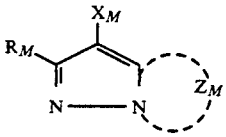

In the formula, $Z_M$ represents a group of nonmetal atoms necessary to form a nitrogen-containing heterocycle which may have a substituent, $X_M$ represents a hydrogen atom or a group capable of splitting off upon reaction with an oxidation product of a color developing agent, and $R_M$ represents a hydrogen aton or a substituent.

Formula [M-II]

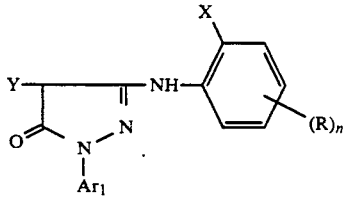

In the formula, $A_{r1}$ represents an aryl group, and X represents a halogen atom or an alkoxy or alkyl group; R represents a substituent capable of linking to a benzene ring; n represents 1 or 2; when n is 2, Rs may be the same or different ones; and Y represents a group capable of splitting off upon coupling with an oxidation product of an aromatic primary amine type color developing agent.

Typical examples of preferable magenta couplers are exemplified below but not limited to them.

MC-1

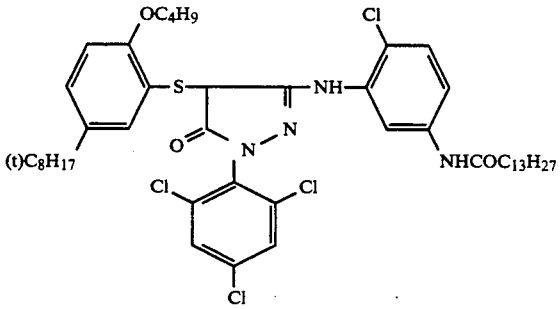

-continued
MC-2
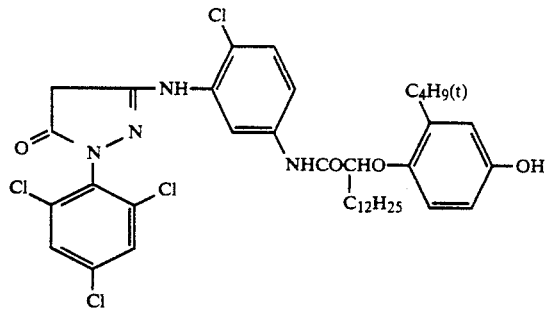
MC-3
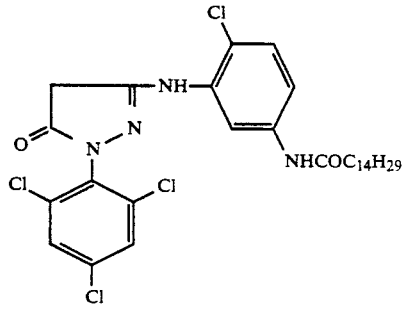
MC-4
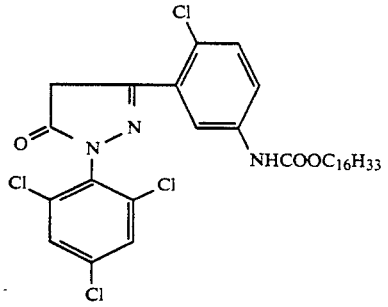
MC-5
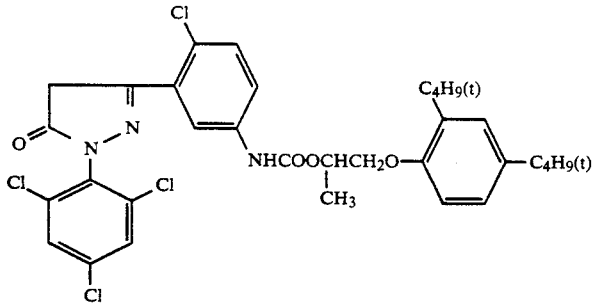
MC-6
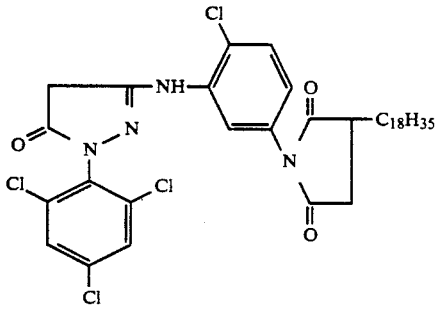

-continued

MC-7

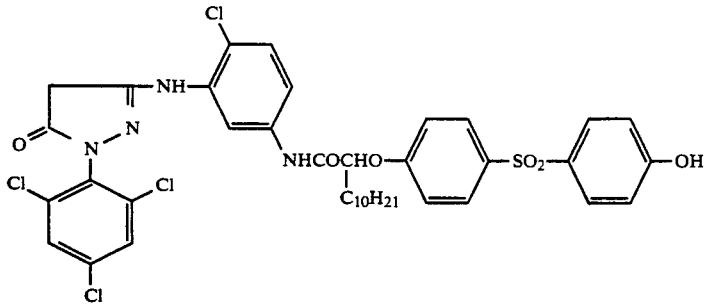

MC-8

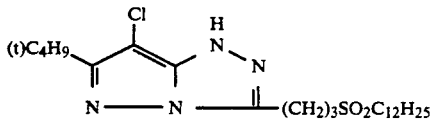

MC-9

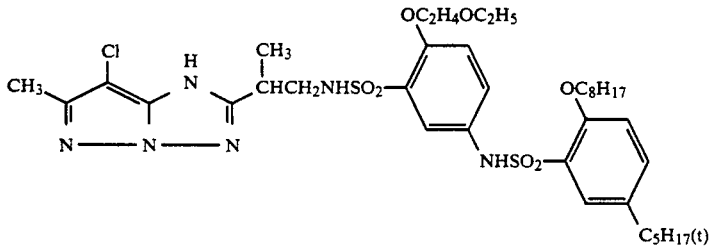

MC-10

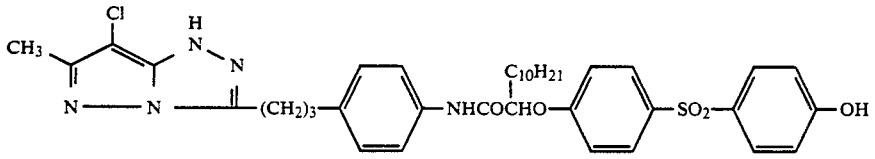

MC-11

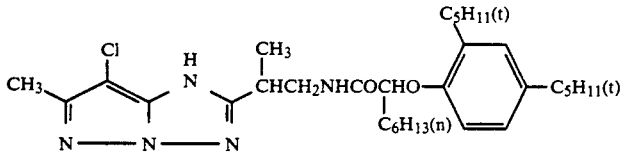

Cyan couplers preferably used in the silver halide color photographic light-sensitive material of the invention are those represented by the following formula [C-I] or [C-II].

Formula [C-I]

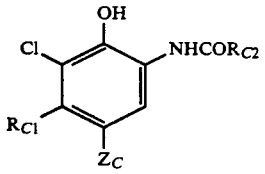

In the formula, $R_{C1}$ represents an alkyl group having 2 to 6 carbon atoms; $R_{C2}$ represents a ballast group; and $Z_C$ represents a hydrogen atom, or an atom or a group capable of splitting off upon reaction with an oxidation product of a color developing agent.

Formula [C-II]

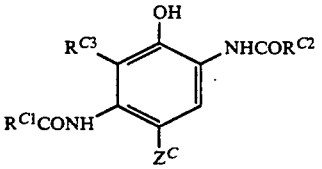

In the formula, $R^{C1}$ represents an alkyl or aryl group, $R^{C2}$ represents an alkyl, cycloalkyl, aryl or heterocyclic group; $R^{C3}$ represents a hydrogen or halogen atom, or an alkyl or alkoxy group; $R^{C3}$ may form a ring in conjunction with $R^{C1}$; and $Z^C$ represents a hydrogen atom or a group capable of splitting off upon reaction with an oxidation product of a color developing agent.

Typical examples of preferable cyan couplers are exemplified below but not limited to them.

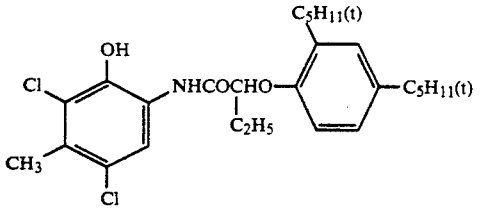
CC-1
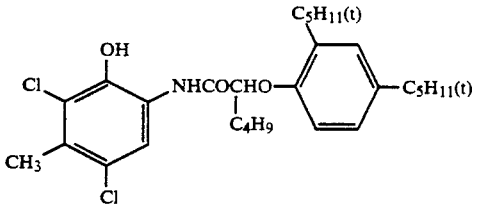
CC-2
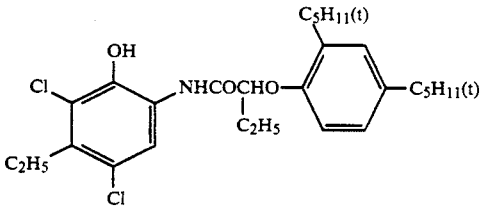
CC-3
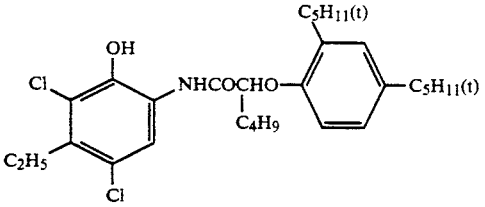
CC-4
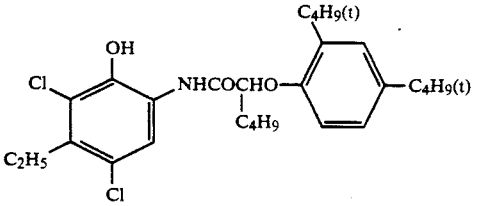
CC-5
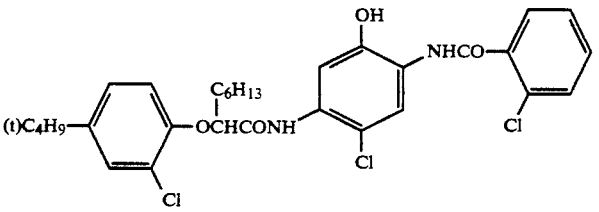
CC-6
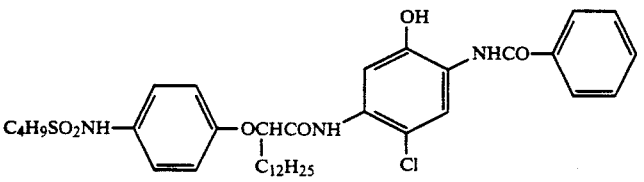
CC-7

-continued

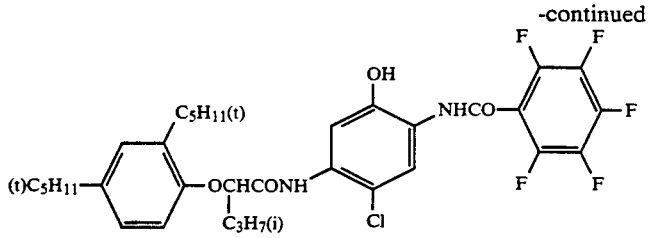

CC-8

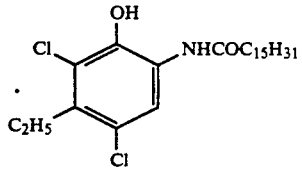

CC-9

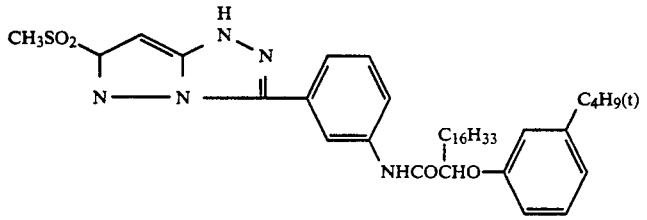

CC-10

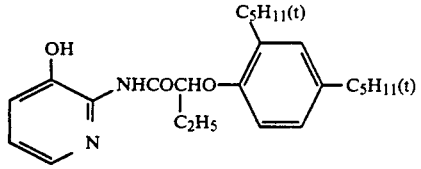

CC-11

When these couplers are incorporated in a silver halide emulsion by use of a oil-in-water type emulsification method, the following steps are generally taken; that is, couplers are dissolved in a water-insoluble high boiling organic solvent having a boiling point higher than 150° C., jointly using a low boiling and/or water-soluble organic solvent if necessary, the solution is then dispersed, with aid of surfactants, in a hydrophilic binder such as aqueous solution of gelatin by use of a dispersing means such as stirrer, homogenizer, colloid mill, flow jet mixer or supersonic equipment, and subsequently the dispersion is added to an objective photographic structural layer (hydrophilic colloid layer). There may be provided a process to remove the low boiling organic solvent after or concurrently with the dispersing.

Examples of the high boiling organic solvent preferably used for this purpose include phthalates such as dibutyl phthalate, di(2-ethylhexyl) phthalate, dinonyl phthalate and dicyclohexyl phthalate; phosphates such as tricresyl phosphate, tri(2-erthylhexyl) phosphate, diphenyl-cresyl phosphate and trihexyl phosphate; organic acid amides such as diethyl lauramide and dibutyl lauramide; phenols such as dinonylphenol and p-dodecylphenol; hydrocarbons such as decalin and dodecylbenzene; and esters such as 1,4-bis(2-ethylhexylcarbonyloxymethyl)cyclohexane and dinonyl adipate. Among them, phthalates, phosphates and other organic acid esters are particularly preferred. These high boiling solvents may be used singly or in combination.

Water-insoluble and organic-solvent-soluble polymers used to disperse couplers include the following compounds.

(1) Vinyl polymers and copolymers (2) Condensation polymers of polyhydric alcohol and polybasic acid (3) Polyestes obtained by ring-opening polymerization (4) Other polymers such as polycarbonate resins, polyurethane resins and polyamide resins The number average molecular weight of these polymers is not particularly limited, but it is preferably less than 200,000, especially 5,000 to 100,000. These polymers are used at polymer:coupler weight ratios of preferably 1:20 to 20:1 and especially 1:10 to 10:1. Typical examples of preferable polymers are shown below. For copolymers, monomer weight ratios are given in parentheses.

(PO-1) Poly(N-t-butylacrylamide)

(PO-2) N-t-butylacrylamide-methyl methacrylate copolymer (60:40)

(PO-3) Polybutyl metacrylate (PO-4) Methyl methacrylate-styrene copolymer (90:10)

(PO-5) N-t-butylacrylamide-2-methoxyethyl acrylate copolymer (55:45)

(PO-6) ω-Methoxypolyethylene glycol acrylate (the number of moles added n=9)-N-t-butylacrylamide copolymer (25:75)

(PO-7) 1,4-butanediol-adipic acid polyester (PO-8) Polypropiolactam

The light-sensitive material according to the invention may use various compounds in order to improve the durability of dye images. Further, various compounds capable of changing the spectral absorptin of dyes formed may be added to the light-sensitive material according to the invention by dissolving and dispersing them together with couplers. Of them, the compound represented by the following formula [A] or [B] is particularly preferred.

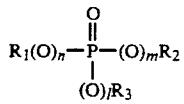

Formula [A]

In the formula, $R_1$, $R_2$ and $R_3$ each represent an aliphatic or aromatic group; l, m and n each represent 0 or 1, provided that l, m and n are not 1 concurrently. Examples of the aliphatic group represented by $R_1$, $R_2$ or $R_3$ include alkyl, alkenyl, alkynyl, cycloalkyl and cycloalkenyl groups, each of which have 1 to 32 carbon atoms. These alkyl, alkenyl and alkynyl groups may be either straight-chained or branched, and may have a substituent. Examples of the aromatic group represented by $R_1$, $R_2$ or $R_3$ are aryl and aromatic heterocyclic groups, preferably alkyl or aryl groups. These aromatic groups may have a substituent. Typical examples of the compound represented by Formula [A] are shown below.

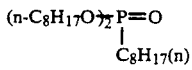

A-1

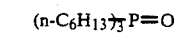

A-2

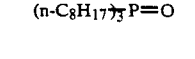

A-3

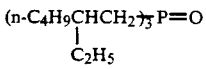

A-4

$R'_1—NHSO_2—R'_2$ Formula [B]

In the formula, $R'_1$ and $R'_2$ each represent an alkyl or aryl group which may have a substituent. Desirably, at least one of $R'_1$ and $R'_2$ is an aryl group; more desirably, both $R'_1$ and $R'_2$ are aryl groups; and most preferably, both $R'_1$ and $R'_2$ are phenyl groups. When $R'_1$ is a phenyl group, Hammett'$\sigma p$ value of a substituent on the p-position of the sulfonamido group is preferably not less than $-0.4$. Examples of the alkyl group represented by $R'_1$ or $R'_2$ include ones having 1 to 32 carbon atoms, such as methyl, ethyl, butyl, nonyl and decyl groups. As the aryl group represented by $R'_1$ or $R'_2$, phenyl groups are preferred. Particularly preferred phenyl groups are those substituted with a halogen atom such as chlorine, bromine or fluorine atom; an alkoxy group such as methoxy, butoxy or dodecyloxy; or an alkyl group such as methyl, butyl or dodecyl. Typical examples of the compound represented by Formula [B] are illustrated below.

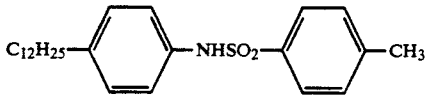

B-1

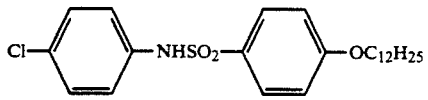

B-2

-continued

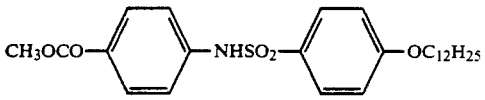

B-3

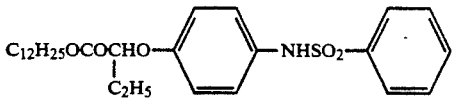

B-4

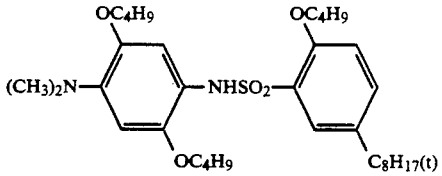

B-5

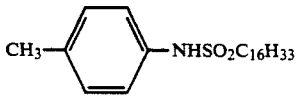

B-6

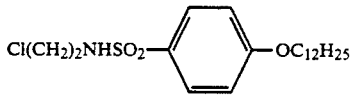

B-7

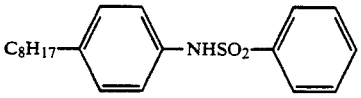

B-8

In addition, compounds capable of releasing a fluorescent dye, which are described in U.S. Pat. No. 4,774,187, may also be employed as another means to modify the spectral absorption.

The kind of silver halide contained in silver halide emulsions used in the invention may be any of silver chloride, silver bromide, silver iodide, silver chlorobromide, silver chloroiodide, silver iodobromide and silver chloroiodobromide. The composition of the silver halide grains may be uniform from the inner portion to the outer portion of the grains, or different from the inner portion to the outer portion. When the composition is different from the inner portion to the outer of the grains, it may change continuously or discontinuously. The size of silver halide grains used in the invention is not particularly limited, but it is preferably in the range of 0.2 to 1.6 μm, and especially 0.25 to 1.2 μm, in view of photographic properties including rapid processability and sensitivity. The grain size distribution of the silver halide grains of the invention may be either polydispersed or monodispersed.

Silver halide emulsions used in the invention can be prepared by use of various apparatus and methods known in the art. Silver halide grains used in the silver halide emulsion according to the invention may be prepared by any of the acid method, neutral method and ammoniacal method. These grains may be grown at a time, or from seed grains prepared beforehand. The method for preparing seed grains and the method for growing them may be the same or different.

The form of the silver halide grains used in the invention may be arbitrarily selected. One of the preferable forms is a cube having a (100) face as crystal face. There may also be employed octahedrons, tetradecahedrons and dodecahedrons prepared according to the methods described in U.S. Pat. Nos. 4,183,756, 4,225,666, Japanese Pat. O.P.I. Pub. No. 26589/1980, Japanese Pat. Exam. Pub. No. 42737/1980 and literature such as The Journal of Photographic Science, 21, 39 (1973). Further, grains having a twin face may be used. The silver halide grain used in the invention may be one having the same form, or a mixture of grains different in forms.

The silver halide photographic light-sensitive material of the invention may contain dyes having absorption in various wavelength areas, for the purposes of anti-irradiation, antihalation and sensitivity adjustment. Any of conventional compounds for this purpose may be used.

In the silver halide photographic light-sensitive material according to the invention, there may be arbitrarily contained an anticolor-mixing agent, hardener, plasticizer, polymer latex, UV absorbent, formalin scavenger, developing accelerator, developing inhibitor, fluorescent whitening agent, matting agent, lubricant, antistatic agent and surfactant.

The silver halide emulsion used in the invention is chemically sensitized by a usual method. Such chemical sensitization is carried out by sulfur sensitization using a sulfur-containing compound capable of reacting with silver ions or an activated gelatin, selenium sensitization using a selenium compound, reduction sensitization using a reducing substance, or combination of these methods.

The silver halide photographic light-sensitive material of the invention has layers containing a silver halide emulsion spectrally sensitized to a specific region within the wavelength area of 400 to 900 nm by combination of a yellow developing coupler, magenta developing coupler and cyan developing coupler. Such a silver halide emulsion contains one or more kinds of sensitizing dyes in combination. In order to enhance the sensitizing effect of the sensitizing dye, the emulsion may contain, together with a sensitizing dye, a supersensitizer which is a dye having no spectral sensitizing function in itself or a compound which substantially absorbs no visible light.

In the silver halide photographic light-sensitive material according to the invention, there may be arbitrarily contained an anticolor-mixing agent, hardener, plasticizer, polymer latex, UV absorbent, formalin scavenger, mordant, developing accelerator, developing inhibitor, fluorescent whitening agent, matting agent, lubricant, antistatic agent and surfactant.

Gelatin is advantageously used as binder in the silver halide light-sensitive material of the invention, but according to a specific requirement, there may be used other hydrophilic colloids such as gelatin derivatives, gelatin grafted with other polymer, proteins other than gelatin, sugar derivatives, cellulose derivatives and synthetic polymers including homo- and co-polymers.

The silver halide photographic light-sensitive material of the invention may be coated with a silver halide emulsion directly or via a subbing layer (one or more subbing layers to enhance the surface adhesion of support, antistatic property, dimensional stability, abrasion, hardness, antihalation property, rubbing characteristics and/or other properties), after its support is subjected to corona discharge, ultraviolet irradiation or flame treatment according to a specific requirement.

In coating the silver halide photographic light-sensitive material of the invention, a thickener may be added to a coating solution to improve the coating property. Preferable coating methods are extrusion coating and curtain coating, which are capable of coating two or more layers simultaneously.

The silver halide photographic light-sensitive material of the invention forms images when subjected to color development in a manner known in the art.

Color developing agents usable in a color developer for processing the photographic light-sensitive material of the invention include aminophenol derivatives and p-phenylenediamine derivatives which are widely used in various color photographic processes. In a color developer for the photographic light-sensitive material of the invention, conventional developer components may be contained in addition to the above aromatic primary amine type color developing agents.

After developing, the silver halide photographic light-sensitive material of the invention is subjected to bleaching and fixing. In general, washing follows the fixing, but stabilizing may be carried out in place of the washing. The apparatus used in developing the light-sensitive material of the invention may be any of a roller transport type which conveys a light-sensitive material while holding it between rollers installed in the processing tank, a endless belt type which conveys a light-sensitive material while fixing it on a belt, and a type in which the processing tank is made into a slit form and a light-sensitive material is fed into it together with a processing solution.

EXAMPLES

EXAMPLE 1

Samples of reflective paper supports different in surface texture were prepared by laminating high density polyethylene on both sides of paper having a basic weight of 180 g/m$^2$. In laminating, anatase-type titanium dioxide was incorporated into the polyethylene for laminating on the side to be coated with emulsions, in an amount of 13 parts per 100 parts of polyethylene. In the course of cooling the laminated polyethylene, various surface textures were formed by use of a cooling roller engraved with various patterns. Sample 101 had the so-called "matted surface", in which fine patterns were arranged at random. Samples 102 and 103 each had patterns changed a little from those used in sample 101. Samples 104 was one called "super-lux" and had patterns a little larger than those used in samples 102 and 103. In samples 105 and 106, patterns ware changed a little from those in sample 104. Measurement results of the WS of these support samples are shown in Table 1.

TABLE 1

| Sample No | $WS_f$ | $(WS_{f/2} \cdot WS_{2f})^{\frac{1}{2}}$ | Remarks |
|---|---|---|---|
| 101 | $3.1 \times 10^{-8}$ | $3.2 \times 10^{-8}$ | Comparison |
| 102 | $2.4 \times 10^{-8}$ | $3.1 \times 10^{-8}$ | Invention |
| 103 | $1.8 \times 10^{-8}$ | $3.1 \times 10^{-8}$ | Invention |
| 104 | $8.1 \times 10^{-8}$ | $8.0 \times 10^{-8}$ | Comparison |
| 105 | $6.9 \times 10^{-8}$ | $8.1 \times 10^{-8}$ | Invention |
| 106 | $4.7 \times 10^{-8}$ | $8.2 \times 10^{-8}$ | Invention |

Silver halide photographic light-sensitive materials were prepared by coating the following seven layers simultaneously on the above supports, at a coating speed of 120 m/min. Coating solutions were prepared as follows.

Coating Solution for the 1st Layer

There were dissolved 26.7 g of yellow coupler (YC-8), 10.0 g of dye image stabilizer (ST-1), 6.67 g of dye image stabilizer (ST-2), 0.67 g of additive (HQ-1) and 6.67 g of high boiling organic solvent (DNP) in 60 ml of ethyl acetate, the solution was then dispersed in 220 ml of 10% aqueous solution of gelatin containing 7 ml of 20% surfactant (SU-1) solution with a supersonic homogenizer to prepare a coupler dispersion. The dispersion was mixed with a blue-sensitive silver halide emulsion (containing 8.68 g of silver) prepared in the manner described later, so that a coating solution for the 1st layer was obtained. Coating solutions for the 2nd to 7th layers were prepared in manners similar to that used in coating solution for the 1st layer. As hardeners, (H-1) was added to the 2nd and 4th layers, and (H-2) to the 7th layer. As a coating aid, surfactants (SU-2) and (SU-3) were used to adjust the surface tension.

| Layer | Constituent | Addition amount ($g/m^2$) |
|---|---|---|
| 7th layer (Protective layer) | gelatin | 1.00 |
| | antimold (F-1) | 0.002 |
| 6th layer (UV absorbing layer) | gelatin | 0.40 |
| | UV absorbent (UV-1) | 0.10 |
| | UV absorbent (UV-2) | 0.04 |
| | UV absorbent (UV-3) | 0.16 |
| | antistain agent (HQ-1) | 0.01 |
| | DNP | 0.20 |
| | PVP | 0.03 |
| | anti-irradiation dye (AI-2) | 0.02 |
| 5th layer (Red-sensitive layer) | gelatin | 1.30 |
| | red-sensitive silver chlorobromide emulsion (Em-R) | 0.21 |
| | cyan coupler (CC-1) | 0.42 |
| | dye image stabilizer (ST-1) | 0.20 |
| | antistain agent (HQ-1) | 0.01 |
| | DOP | 0.20 |
| 4th layer (UV absorbing layer) | gelatin | 0.94 |
| | UV absorbent (UV-1) | 0.28 |
| | UV absorbent (UV-2) | 0.09 |
| | UV absorbent (UV-3) | 0.38 |
| | antistain agent (HQ-1) | 0.03 |
| | DNP | 0.40 |
| 3rd layer (Green-sensitive layer) | gelatin | 1.40 |
| | green-sensitive silver chlorobromide emulsion (Em-G) | 0.17 |
| | magenta coupler (MC-8) | 0.35 |
| | dye image stabilizer (ST-3) | 0.15 |
| | dye image stabilizer (ST-4) | 0.15 |
| | dye image stabilizer (ST-5) | 0.15 |
| | DNP | 0.20 |
| | anti-irradiation dye (AI-1) | 0.02 |
| 2nd layer (Intermediate layer) | gelatin | 1.20 |
| | antistain agent (HQ-2) | 0.12 |
| | DIDP | 0.15 |
| | antimold | 0.002 |
| 1st layer (Blue-sensitive layer) | gelatin | 1.20 |
| | blue-sensitive silver chlorobromide emulsion (Em-B) | 0.26 |
| | yellow coupler (YC-8) | 0.80 |
| | dye image stabilizer (ST-1) | 0.30 |
| | dye image stabilizer (ST-2) | 0.20 |
| | antistain agent (HQ-1) | 0.02 |
| | anti-irradiation dye (AI-3) | 0.01 |
| | DNP | 0.20 |
| Support | polyethylene-laminated paper | |

The addition amount of silver halide emulsion is given in an amount of silver present.

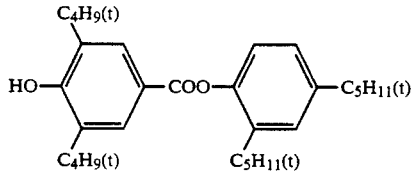

ST-1

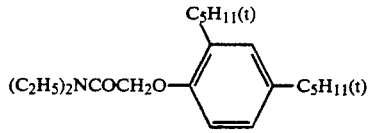

ST-2

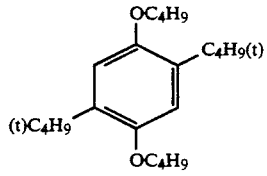

ST-3

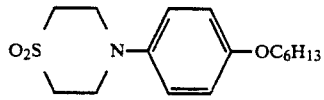

ST-4

-continued
ST-5
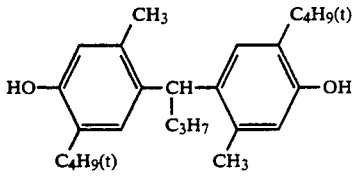
UV-1
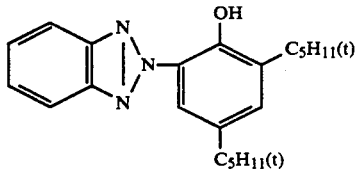
UV-2
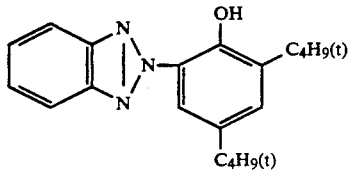
UV-3
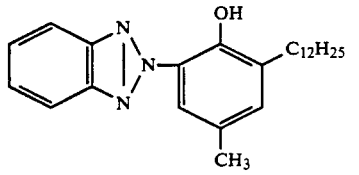
DOP Dioctyl phthalate
DNP Dinonyl phtalate
DIDP Diisodecyl phthalate
PVP Polyvinylpyrrolidone
HQ-1
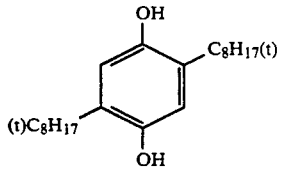
HQ-2
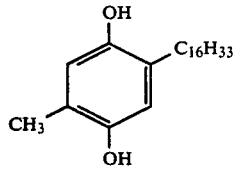
AI-1
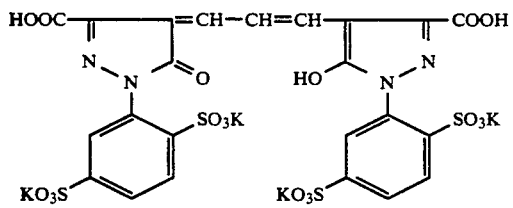
AI-2
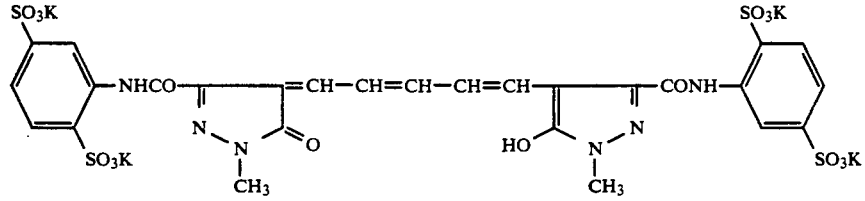

-continued

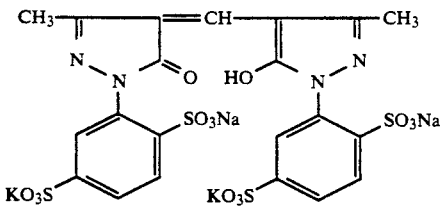

AI-3

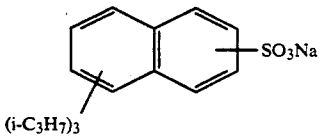

SU-1

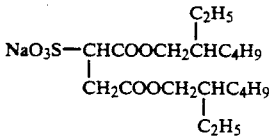

SU-2

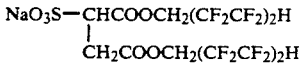

SU-3

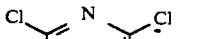

H-1

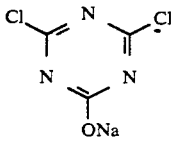

H-2

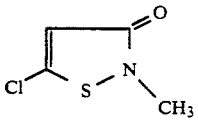

F-1

Preparation of Blue-Sensitive Silver Halide Emulsion

The following solutions (A) and (B) were simultaneously added to 1000 ml of 2% aqueous solution of gelatin kept at 40° C. over a period of 30 minutes, while controlling the pAg at 6.5 and the pH at 3.0. Then, the following solutions (C) and (D) were simultaneously added thereto over a period of 180 minutes, while controlling the pAg at 7.3 and the pH at 5.5. The control of the pAg was made according to the method described in Japanese Pat. O.P.I. Pub. No. 45437/1984, and the pH was controlled by use of sulfuric acid or an aqueous solution of sodium hydroxide.

| | |
|---|---|
| Solution (A) | |
| Sodium chloride | 3.42 g |
| Potassium bromide | 0.03 g |
| Water to make | 200 ml |
| Solution (B) | |
| Silver nitrate | 10 g |
| Water to make | 200 ml |
| Solution (C) | |
| Sodium chloride | 102.7 g |
| Potassium bromide | 1.0 g |
| Water to make | 600 ml |
| Solution (D) | |
| Silver nitrate | 300 g |
| Water to make | 600 ml |

After the addition, the resultant silver halide grains were subjected to desalting using a 5% aqueous solution of Demol N made by Kao Atlas Co. and a 20% aqueous solution of magnesium sulfate, and then mixed with an aqueous solution of gelatin, so that monodispersed emulsion EMP-1 comprised of cubic grains having an average grain size of 0.85 μm, a variation coefficient of grain size distribution (S/$\bar{r}$) of 0.07 and a silver chloride content of 99.5 mol % was obtained Emulsion EMP-1 was chemically sensitized for 90 minutes at 50° C. by use of the following compounds, blue-sensitive silver halide emulsion (Em-B) was thus obtained.

| | |
|---|---|
| Sodium thiosulfate | 0.8 mg/mol AgX |
| Chloroauric acid | 0.5 mg/mol AgX |
| Stabilizer STAB-1 | $6 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

Preparation of Green-Sensitive Silver Halide Emulsion

There was prepared monodispersed emulsion EMP-2 comprised of cubic grains having an average grainsize of 0.43 μm, a variation coefficient of grain size distribution (S/r̄) of 0.08 and a silver chloride content of 99.5 mol %, in the same manner as with EMP-1 except that the addition time of solutions (A) and (B) and that of solutions (C) and (D) were changed.

Subsequently, emulsion EMP-2 was chemically sensitized for 120 minutes at 55° C. by use of the following compounds, so that green-sensitive silver halide emulsion (Em-G) was obtained.

| | |
|---|---|
| Sodium thiosulfate | 1.5 mg/mol AgX |
| Chloroauric acid | 1.0 mg/mol AgX |
| Stabilizer STAB-1 | $6 \times 10^{-4}$ mol/mol AgX |
| Sensitizing dye GS-1 | $4 \times 10^{-4}$ mol/mol AgX |

Preparation of Red-Sensitive Silver Halide Emulsion

There was prepared monodispersed emulsion EMP-3 comprised of cubic grains having an average grainsize of 0.50 μm, a variation coefficient of grain size distribution (S/r̄) of 0.08 and a silver chloride content of 99.5 mol %, in the same manner as with EMP-1 except that the addition time of solutions (A) and (B) and that of solutions (C) and (D) were changed.

Subsequently, emulsion EMP-3 was chemically sensitized for 90 minutes at 60° C. by use of the following compounds, so that red-sensitive silver halide emulsion Em-R) was obtained.

| | |
|---|---|
| Sodium thiosulfate | 1.8 mg/mol AgX |
| Chloroauric acid | 2.0 mg/mol AgX |
| Stabilizer STAB-1 | $6 \times 10^{-4}$ mol/mol AgX |
| Sensitizing dye RS-1 | $1 \times 10^{-4}$ mol/mol AgX |

STAB-1

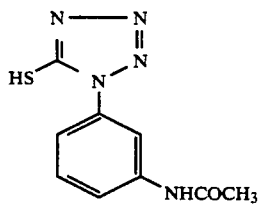

BS-1

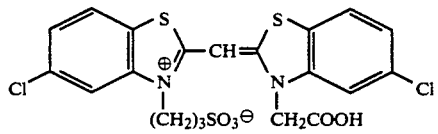

BS-2

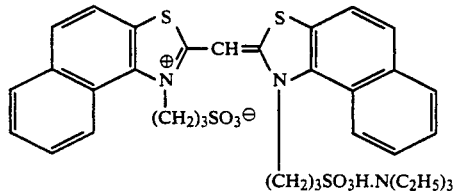

GS-1

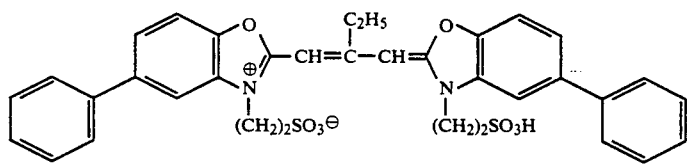

RS-1

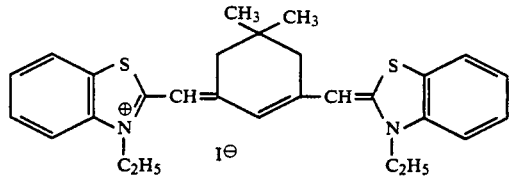

The silver halide photographic light-sensitive materials prepared as above were exposed through a color negative and then processed in the following procedure to obtain color prints.

| [0076] Processing | Temperature | Time |
|---|---|---|
| Color developing | 35.0 ± 0.3° C. | 45 sec |
| Bleach-fixing | 35.0 ± 0.5° C. | 45 sec |
| Stabilizing | 30 to 34° C. | 90 sec |
| Drying | 60 to 80° C. | 60 sec |

| Color developer | |
|---|---|
| Deionized water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |

-continued

| | |
|---|---|
| 1-Hydroxyethylidene-1,1-diphosphonic acid | 1.0 g |
| Ethylenediaminetetracetic acid | 1.0 g |
| Disodium catechol-3,5-disulfonate | 1.0 g |
| N-Ethyl-N-β-methanesulfonamidethyl-3-methyl -4-aminaniline sulfate | 4.5 g |
| Fluorescent whitening agent (4,4'-diaminostilbene disulfonate derivative) | 1.0 g |
| Potassium carbonate | 27 g |

Water was added to make the total volume 1 liter, and then the pH was adjusted to 10.10 with glacial acetic acid.

| Bleach-Fixer | |
|---|---|
| Ammonium ferric ethylenediaminetetracetate dihydrate | 60 g |
| Ethylenediaminetetracetic acid | 3 g |
| Ammonium thiosulfate (70% aqueous solution) | 100 ml |
| Ammonium sulfite (40% aqueous solution) | 27.5 ml |

Water was added to make the total volume 1 liter, then the pH was adjusted to 5.7 with potassium carbonate or glacial acetic acid.

| Stabilizer | |
|---|---|
| 5-Chloro-2-methyl-4-isothiazoline-3-one | 1.0 g |
| Ethylene glycol | 1.0 g |
| 1-Hydroxyethylidene-1,1-diphosphonic acid | 2.0 g |
| Ethylenediaminetetracetic acid | 1.0 g |
| Ammonium hydroxide (20% aqueous solution) | 3.0 g |
| Fluorescent whitening agent (4,4'-diaminostilbene disulfonate derivative) | 1.5 g |

Water was added to make the total volume 1 liter, then the pH was adjusted to 7.0 with sulfuric acid or potassium hydroxide.

The color prints prepared as above were shown to ten monitors for their sensuous appraisals from viewpoints of gloss, visual hardness and description of details. The monitors appraised each print by a five-grade marking method which gives a mark of 1 for bad quality, mark of 3 for fair quality and mark of 5 for excellent quality. And mean values were taken for respective prints to report in Table 2.

As apparent from the table, the quality of the gloss is not influenced by the intensity distribution of WS; that is, sample 101 is much the same as samples 102 and 103, and sample 104 is much the same as samples 105 and 106, in the quality of the gloss. But the visual hardness and description of details are substantially influenced by the intensity distribution of WS, and better results are obtained for ones whose intensity of WS at a special frequency of f cycles/mm is smaller than the geometric mean of its intensity of WS at a special frequency of 2f cycles/mm and its intensity of WS at a special frequency of f/2 cycles/mm.

TABLE 2

| Sample No | Quality of gloss | Visual hardness | Description of details |
|---|---|---|---|
| 101 | 2.9 | 2.9 | 2.6 |
| 102 | 3.0 | 3.4 | 3.4 |
| 103 | 3.0 | 3.7 | 4.0 |
| 104 | 3.7 | 3.4 | 2.3 |
| 105 | 3.8 | 3.9 | 3.7 |
| 106 | 3.8 | 4.2 | 4.1 |

EXAMPLE 2

Samples 201 to 206 were prepared in the same manner as with samples 101 to 106 in Example 1, except that the coating speed was changed to 200 m/min. The measurement results of WS of respective supports are shown in Table 3.

TABLE 3

| Sample No | $WS_f$ | $(WS_{f/2} \cdot WS_{2f})^{1/2}$ | Remarks |
|---|---|---|---|
| 201 | $5.0 \times 10^{-8}$ | $5.1 \times 10^{-8}$ | Comparison |
| 202 | $4.1 \times 10^{-8}$ | $5.2 \times 10^{-8}$ | Invention |
| 203 | $3.4 \times 10^{-8}$ | $5.0 \times 10^{-8}$ | Invention |
| 204 | $4.5 \times 10^{-7}$ | $4.4 \times 10^{-7}$ | Comparison |
| 205 | $3.4 \times 10^{-7}$ | $4.3 \times 10^{-7}$ | Invention |
| 206 | $3.0 \times 10^{-7}$ | $4.4 \times 10^{-7}$ | Invention |

In the same manner as in Example 1, the silver halide photographic light-sensitive materials prepared as above were exposed through a color negative and processed to obtain color prints, which were then evaluated as in Example 1.

The results are summarized in Table 4. The marking for the quality of the gloss is slightly lowered as compared with that in Example 1, but in general, there is little difference between them. Accordingly, it can be said that the quality of the gloss is not influenced by the intensity distribution of WS. That is, sample 201 is much the same as samples 202 and 203, and sample 204 is much the same as samples 205 and 206, in the quality of the gloss. In general, the visual hardness and description of details are also lowered a little and these are substantially influenced by the intensity distribution of WS as seen in Example 1. But it is understood that better results are obtained when the intensity of WS at a spatial frequency of f cycles/mm is smaller than the geometric means of the intensity of WS at a special frequency of 2f cycles/mm and that at a special frequency of f/2 cycles/mm.

TABLE 4

| Sample No | Quality of gloss | Visual hardness | Description of details |
|---|---|---|---|
| 201 | 2.9 | 2.7 | 2.4 |
| 202 | 2.9 | 3.2 | 3.2 |
| 203 | 3.0 | 3.4 | 3.7 |
| 204 | 3.7 | 3.2 | 2.1 |
| 205 | 3.8 | 3.7 | 3.5 |
| 206 | 3.7 | 3.8 | 3.8 |

A further experiment similar to the above, which was made with samples prepared at a coating speed of 220 m/min, also proved the effect of the invention.

EXAMPLE 3

Silver halide photographic light-sensitive material samples 301 and 302 were prepared in the same procedure as with samples 102 and 105 in Example 1, except that patterns which were similar to those used in samples 102 and 105 but different in WS ratios were employed. The measurement results of WS of respective supports are shown in Table 5.

TABLE 5

| Sample No | $WS_f$ | $(WS_{f/2} \cdot WS_{2f})^{1/2}$ | $(WS_{f/2}/WS_{2f})$ | Remarks |
|---|---|---|---|---|
| 102 | $2.4 \times 10^{-8}$ | $3.1 \times 10^{-8}$ | 0.48 | Invention |
| 105 | $6.9 \times 10^{-8}$ | $8.1 \times 10^{-8}$ | 0.51 | Invention |
| 301 | $2.3 \times 10^{-8}$ | $3.2 \times 10^{-8}$ | 0.72 | Invention |

TABLE 5-continued

| Sample No | $WS_f$ | $(WS_{f/2} \cdot WS_{2f})^{\frac{1}{2}}$ | $(WS_{f/2}/WS_{2f})$ | Remarks |
|---|---|---|---|---|
| 302 | $6.9 \times 10^{-7}$ | $8.0 \times 10^{-7}$ | 0.73 | Invention |

The silver halide photographic light-sensitive materials prepared as above were exposed through a color negative and processed to obtain color prints. The color prints were subjected to evaluation in the same manner as in Example 1. Further, these were evaluated for the unnaturalness of images when viewed, which is attributable to irregularities.

The result are shown in Table 6. For these four samples, any of the relations between the intensity of WS at a spatial frequency of f cycles/mm and the geometric mean of the intensity of WS at a spatial frequency of f/2 cycles/mm and that at a spatial frequency of 2f cycles/mm meets the requirement specified by the invention, but some of the ratios of WS intensity at a spatial frequency of f/2 cycles/mm to that at 2f cycles/mm deviate from the favorable range specified above. Though the quality of the gloss, visual hardness and description of details are not influenced so much by such deviations, the naturalness when samples are viewed is substantially influenced. As a result, samples 301 and 302, in which the ratio of WS intensities at a spatial frequency of 2f cycles/mm to that of f/2 cycles/mm satisfies $$0.15 \leqq \frac{WS_{2f}}{WS_{f/2}} \leqq 0.65,$$

TABLE 6

| Sample No. | Quality of gloss | Visual hardness | Description of details | Naturalness |
|---|---|---|---|---|
| 102 | 3.0 | 3.4 | 3.4 | 4.2 |
| 105 | 3.8 | 3.9 | 3.7 | 3.6 |
| 301 | 3.0 | 3.3 | 3.1 | 3.7 |
| 302 | 3.5 | 3.7 | 3.4 | 3.2 |

What is claimed is;

1. A silver halide photographic light-sensitive material formed by coating at least one silver halide photographic emulsion layer on a reflective support having irregularities at random on the surface, wherein the intensity of Wiener spectrum of the reflective support at a spatial frequency of f cycles/mm given by the expression f=1120/(coating speed) is less than 90% of the geometric mean of the intensity at a spatial frequency of f/2 cycles/mm and the intensity at a spatial frequency of 2f cycles/mm when the coating speed for said silver halide emulsion layer is in meters/minute.

2. The material of claim 1, wherein the ratio of Wiener spectrum (WS) intensities at the spatial frequency of 2f cycles/mm ($WS_{2f}$) to that at the spatial frequency of f/2 cycles/mm ($WS_{f/2}$) is within the range of $0.15 \leqq WS_{2f}/WS_{f/2} \leqq 0.65$.

3. The material of claim 1, wherein a yellow coupler contained in said silver halide photographic emulsion layer, is represented by Formula Y-I;

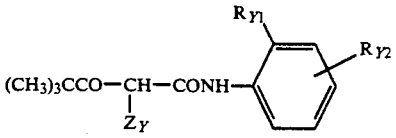

Formula Y-I wherein $R_{Y1}$ represents a halogen atom or an alkoxy group, $R_{Y2}$ represents $-NHCOR_{Y3}SO_2R_{Y4'}$, $-COOR_{Y4'}$, $-NHCOR_{Y4'}$, $-COOR_{Y3}COOR_{Y4'}$, $$-\underset{\underset{R_{Y5}}{|}}{NSO_2R_{Y4}} \quad \text{or} \quad -\underset{\underset{R_{Y5}}{|}}{SO_2NR_{Y4}},$$

$R_{Y3}$ represents an alkylene group, $R_{Y4}$ represents an antidiffusible group, $R_{Y5}$ represents a hydrogen atom, an alkyl group or an aralkyl group, and $Z_Y$ represents a group capable of splitting off upon coupling.

4. The material of claim 1, wherein a magenta coupler contained in said silver halide photographic emulsion layer, is represented by Formula M-I;

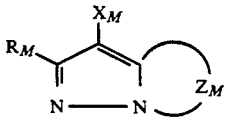

Formula M-I wherein $Z_M$ represents a group of nonmetal atoms necessary to form a nitrogen-containing heterocyclic ring that may have a substituent, $X_M$ represents a hydrogen atom, a group capable of splitting off upon reaction with an oxidation product of a color developing agent, and $R_M$ represents a hydrogen atom or a substituent.

5. The material of claim 1, wherein a cyan coupler contained in said silver halide photographic emulsion layer, is represented by Formula C-I;

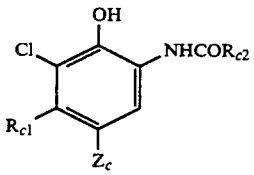

Formula C-I wherein $R_{C1}$ represents an alkyl group having 2 to 6 carbon atoms, $R_{C2}$ represents a ballast group, $Z_C$ represents a hydrogen atom or a group capable of splitting off upon reaction with an oxidation product of a color developing agent.

6. The material of claim 1, wherein a cyan coupler contained in said silver halide photographic emulsion layer, is represented by Formula C-II;

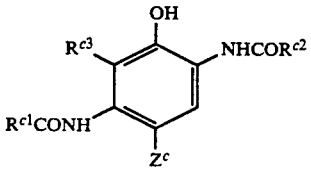

Formula C-II wherein $R^{C1}$ represents an alkyl group, an aryl group, $R^{C2}$ represents an alkyl group, an aryl group, $R^{C2}$ represents an alkyl group, a cycloalkyl group, an aryl group, a heterocyclic group, $R^{C3}$ represents a hydrogen atom, a halogen atom, an alkyl group, an alkoxy group, $R^{C3}$ may form a ring in conjunction with $R^{C1}$, $Z^C$ represents a hydrogen atom or a group capable of splitting off upon reaction with an oxidation product of a color developing agent.

7. The material of claim 1, wherein a compound contained in said silver halide photographic emulsion layer, is represented by Formula B;

$$R'_1—NHSO_2—R'_2 \qquad \text{Formula B}$$

wherein $R'_1$ and $R'_2$ each represents an alkyl group or an aryl group that may have a substituent.

8. A silver halide photographic light-sensitive material formed by coating at least one silver halide photographic emulsion layer on a reflective support having irregularities at random on the surface, wherein the intensity of Wiener spectrum (WS) of the reflective support at a spatial frequency of f cycles/mm given by the expression f=1120/(coating speed) is less than 60% of the geometric mean of the Wiener Spectrum intensity at a spatial frequency of f/2 cycles/mm ($WS_{f/2}$) and the Wiener spectrum intensity at a spatial frequency of 2f cycles/mm ($WS_{2f}$) when the coating speed for said silver halide emulsion layer is measured in meters per minute, the ratio of Wiener spectrum intensities at the spatial frequency of 2f cycles/mm to that at the spatial frequency of f/2 cycles/mm is within the range of $0.15 \leqq WS_{2f}/WS_{f/2} \leqq 0.65$.

* * * * *